US008876381B2

(12) United States Patent
Liao

(10) Patent No.: US 8,876,381 B2
(45) Date of Patent: Nov. 4, 2014

(54) TBAG BOTTOM CUSHIONING STRUCTURE FOR INFLATED AIR CUSHION BAG

(71) Applicant: Yaw Shin Liao, New Taipei (TW)

(72) Inventor: Yaw Shin Liao, New Taipei (TW)

( * ) Notice: Subject to any disclaimer, the term of this patent is extended or adjusted under 35 U.S.C. 154(b) by 18 days.

(21) Appl. No.: 13/747,476

(22) Filed: Jan. 23, 2013

(65) Prior Publication Data

US 2014/0205208 A1 Jul. 24, 2014

(51) Int. Cl.
*B65D 30/00* (2006.01)
*B65D 81/02* (2006.01)
*B65D 81/05* (2006.01)

(52) U.S. Cl.
CPC ..... *B65D 81/052* (2013.01)
USPC ..... 383/3; 206/522

(58) Field of Classification Search
CPC ..... B65D 81/052; B65D 81/03; B31B 19/84; B31B 2219/9058; B31B 5/0073
USPC ..... 383/3; 206/522
See application file for complete search history.

(56) References Cited

U.S. PATENT DOCUMENTS

| | | | | |
|---|---|---|---|---|
| 7,000,767 | B2 * | 2/2006 | Tanaka et al. | 206/522 |
| 7,204,278 | B2 * | 4/2007 | Koyanagi et al. | 141/114 |
| 8,016,110 | B2 * | 9/2011 | Zhang et al. | 206/522 |
| 2013/0168286 | A1 * | 7/2013 | Liao et al. | 206/522 |

* cited by examiner

*Primary Examiner* — Jes F Pascua

(57) ABSTRACT

A bag bottom cushioning structure for an inflated air cushion bag is provided at the bottom of the bag and has air columns rendered into a bent configuration to form an extended curved-surface cushioning space. The bag has a first wall, a second wall, and a bottom wall connecting the bottoms of the first and second walls. The three walls form a receiving space therebetween. The tops of the first and second walls form a bag opening therebetween in communication with the receiving space. The bottom wall is provided at intervals with air columns extending toward the bag opening along the first and second walls respectively. The two inner lateral surfaces of the bottom wall are bonded together by one or more fixedly connecting portions such that the air columns on the bottom wall are bent, and thus protrude, away from the bag opening, forming the extended curved-surface cushioning space.

9 Claims, 6 Drawing Sheets

-Prior Art-

TBAG BOTTOM CUSHIONING STRUCTURE FOR INFLATED AIR CUSHION BAG

BACKGROUND OF THE INVENTION

1. Technical Field

The present invention relates to a bag bottom cushioning structure for an inflated air cushion bag. More particularly, the present invention relates to an inflated air cushion bag having a plurality of air columns on its surface. Even more particularly, the present invention relates to a cushioning structure which is provided at the bottom of an inflated air cushion bag and which has air columns rendered into a bent configuration to form an extended curved-surface cushioning space.

2. Description of Related Art

Inflated air cushion bags, which are characterized by the cushioning air columns on their surface, are now extensively used in the packaging of fragile objects. The air columns provide a cushioning effect when the packaged objects are subjected to collision or external impact, thereby preventing the objects from damage.

FIG. 6 shows a conventional inflated air cushion bag 1*b*, which has a receiving space 13*b* therein for receiving an object 9. A bag opening 11*b* is formed at the top of the bag 1*b* and communicates with the receiving space 13*b*. Two lateral walls and the bottom 12*b* of the bag 1*b* are typically formed with a plurality of air columns 61*b*, 62*b*, 63*b* divided from one another by hot-sealed lines. The air columns 61*b*, 62*b*, 63*b* extend mainly along the axial direction of the bag opening 11*b* and of the bottom 12*b*. The air columns 61*b*, 62*b*, 63*b* can be wrapped around the object 9 along with the bag 1*b* such that, when the bag 1*b* is subjected to collision or external impact, the air columns 61*b*, 62*b*, 63*b* provide a shock absorbing and cushioning effect to the object 9 packaged in the bag 1*b* and thus prevent the object 9 from breakage or damage during transportation.

However, once the object 9 is placed in the receiving space 13*b* of the bag 1*b*, there is only a small gap left between the bottom of the object 9 and the inner bottom surface of the receiving space 13*b*, or the bottom of the object 9 is in direct contact with the inner bottom surface of the receiving space 13*b*, due to the weight of the object 9. Both configurations are disadvantageous in that, should the bottom 12*b* of the bag 1*b* hit the ground, there will be insufficient cushioning space between the bottom of the object 9 and the inner bottom surface of the receiving space 13*b*. Chances are the impact force generated by the bottom 12*b* of the bag 1*b* hitting the ground will be directly transmitted to the bottom of the object 9 and cause damage thereto.

BRIEF SUMMARY OF THE INVENTION

It is an objective of the present invention to provide a cushioning structure which is disposed at the bottom of an inflated air cushion bag and which has air columns rendered into a bent configuration to form an extended curved-surface cushioning space. The cushioning structure is intended to overcome the aforesaid drawbacks of the conventional inflated air cushion bag, namely the possibility of damage caused to the object in the bag by an impact force which is generated by the bottom of the bag hitting the ground and which is directly transmitted to the bottom of the object because of the tiny gap, if any, between the object and the bottom of the bag as a result of the weight of the object.

To achieve the above objective, the present invention provides a bag bottom cushioning structure for an inflated air cushion bag, wherein the bag bottom cushioning structure is provided at the bottom of the bag, and wherein the bag has a first wall, a second wall, and a bottom wall connecting the bottom of the first wall and the bottom of the second wall. The first wall and the second wall are connected to each other along two lateral edges thereof. The first wall, the second wall, and the bottom wall jointly form a receiving space therebetween. The top of the first wall and the top of the second wall form a bag opening therebetween which communicates with the receiving space. The bottom wall is provided with a plurality of air columns arranged at intervals. The air columns extend toward the bag opening along the first wall and the second wall respectively. The bag bottom cushioning structure is characterized in that:

the bottom wall has two inner lateral surfaces bonded together by one or more fixedly connecting portions in such a way that the air columns on the bottom wall are bent, and hence protrude, away from the bag opening, form an included angle, and, because of the bent configuration, form an extended curved-surface cushioning space.

Thus, without using additional material, a change in structure is effected by bonding together the two inner lateral surfaces of the bottom wall with the one or more fixedly connecting portions. In consequence, the air columns on the bottom wall are bent, and protrude, away from the bag opening along with the two inner lateral surfaces of the bottom wall, forming a bent configuration in which the air columns form the extended curved-surface cushioning space at the bottom of the bag. The extended curved-surface cushioning space is shaped as a triangle tapering toward the bottom of the bag.

After an object is put into the receiving space through the bag opening, the outer surface of the object is wrapped between the first wall and the second wall. As the extended curved-surface cushioning space tapers toward the bottom of the bag, the bottom of the object is kept from entering the extended curved-surface cushioning space completely. In fact, the extended curved-surface cushioning space will be located between the bottom of the object and the inner bottom surface of the receiving space. Therefore, should the bottom of the bag hit the ground, the impact force thus generated will be absorbed by both the air columns on the bottom wall and the extended curved-surface cushioning space and is thereby prevented from damaging the object.

According to the above, the extended curved-surface cushioning space lying between the object and the bottom of the receiving space is formed by bending the bottom of the bag and by means of the one or more fixedly connecting portions, and this can be done without using additional material. Such a structural change alters the extending direction of the air columns on the bottom of the bag, causing the two symmetric inner lateral surfaces of the bottom wall to form an included angle. Consequently, the extended curved-surface cushioning space provides a buffer distance as great as the depth of the extended curved-surface cushioning space, and the objective of rendering the air columns at the bottom of the bag into a bent configuration that forms the extended curved-surface cushioning space is achieved.

First hot-sealed nodes are provided between the air columns on the first wall and the air columns on the bottom wall. Each first hot-sealed node is flanked by one or a pair of first air paths, with each first air path in communication between one air column on the first wall and one air column on the bottom wall. Second hot-sealed nodes are provided between the air columns on the second wall and the air columns on the bottom wall. Each second hot-sealed node is flanked by one or a pair of second air paths, with each second air path in communication between one air column on the second wall and one air column on the bottom wall.

The one or more fixedly connecting portions are provided at the air columns on the bottom wall or are provided between the air columns on the bottom wall.

To achieve the above objective, the present invention provides another bag bottom cushioning structure for an inflated air cushion bag, wherein the bag bottom cushioning structure is provided at the bottom of the bag, and wherein the bag has a receiving space therein and a top having a bag opening in communication with the receiving space. In addition, the bottom of the bag is provided at intervals with a plurality of air columns. The air columns extend toward the bag opening along two lateral walls of the bag respectively. The bag bottom cushioning structure is characterized in that:

the receiving space has two inner lateral surfaces bonded together at the bottom of the bag by one or more fixedly connecting portions such that the air columns on the bottom of the bag are bent, and hence protrude, away from the bag opening, form an included angle, and, because of the bent configuration, form an extended curved-surface cushioning space.

Thus, the objective of rendering the air columns on the bottom of the bag into a bent configuration to form an extended curved-surface cushioning space is achieved.

The one or more fixedly connecting portions are provided at the air columns on the bottom of the bag or are provided between the air columns on the bottom of the bag.

Besides, the present invention has the following technical features:

Each fixedly connecting portion has a dot-like or linear configuration. The one or more fixedly connecting portions are formed at the bottom of the bag by welding. The lateral edges of the bag are each provided with a sunken hot-pressed lateral connecting line extending from the bag opening to the bottom of the bag. Each lateral edge of the bag is divided by the corresponding lateral connecting line into an outwardly turned first lateral air column on one side of the bag and an outwardly turned second lateral air column on the opposite side of the bag. Each pair of the corresponding first and second lateral air columns are connected to each other side by side to forma lateral cushioning surface facing sideways of the bag.

BRIEF DESCRIPTION OF THE SEVERAL VIEWS OF THE DRAWINGS

The structure as well as a preferred mode of use, further objectives, and advantages of the present invention will be best understood by referring to the following detailed description of some illustrative embodiments in conjunction with the accompanying drawings, in which.

DETAILED DESCRIPTION OF THE INVENTION

Figure 1:
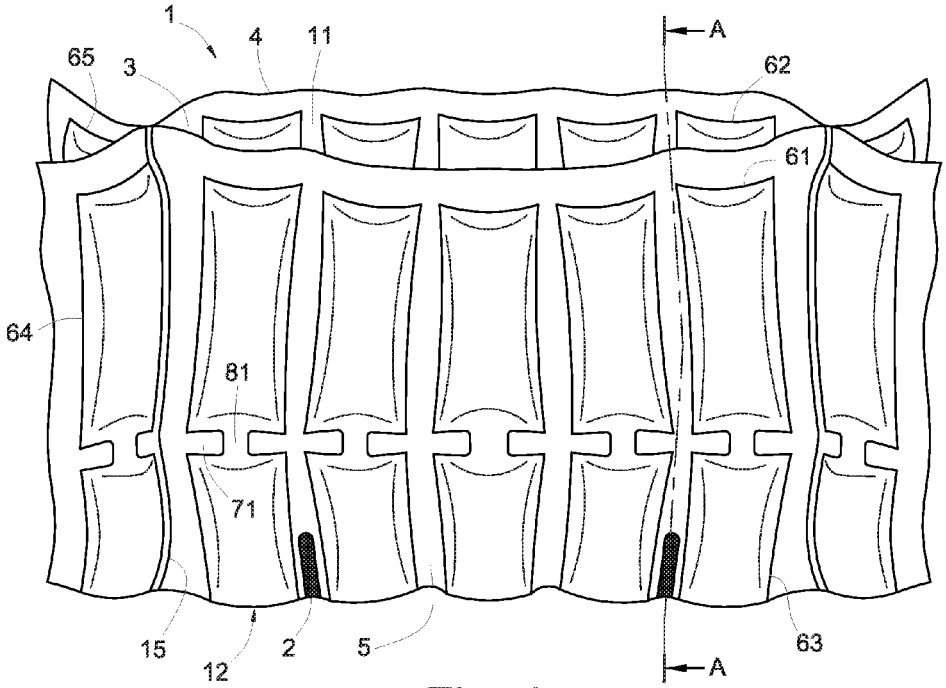
FIG. 1 is a front perspective view of the first embodiment of the present invention.
Figure 2:
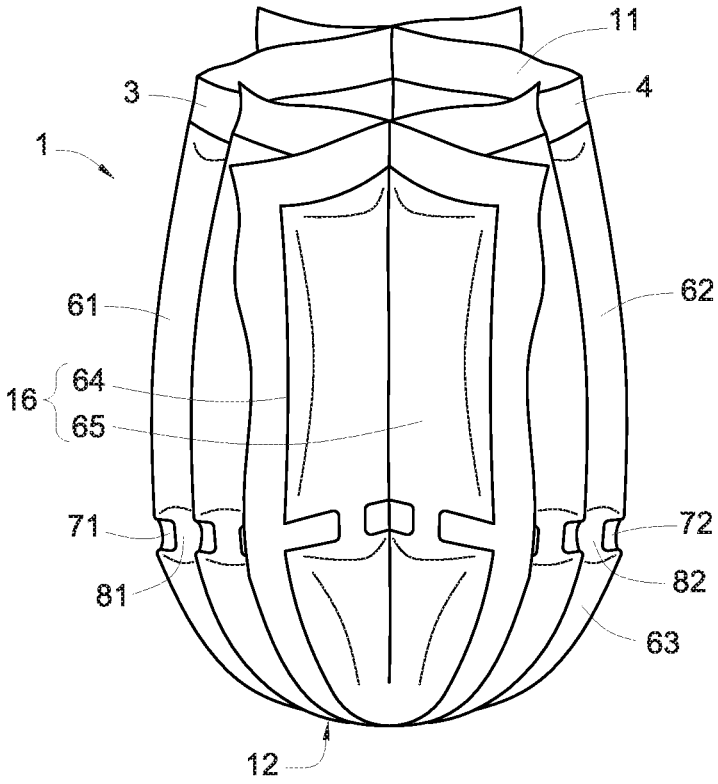
FIG. 2 is a side perspective view of FIG. 1.
Figure 3:
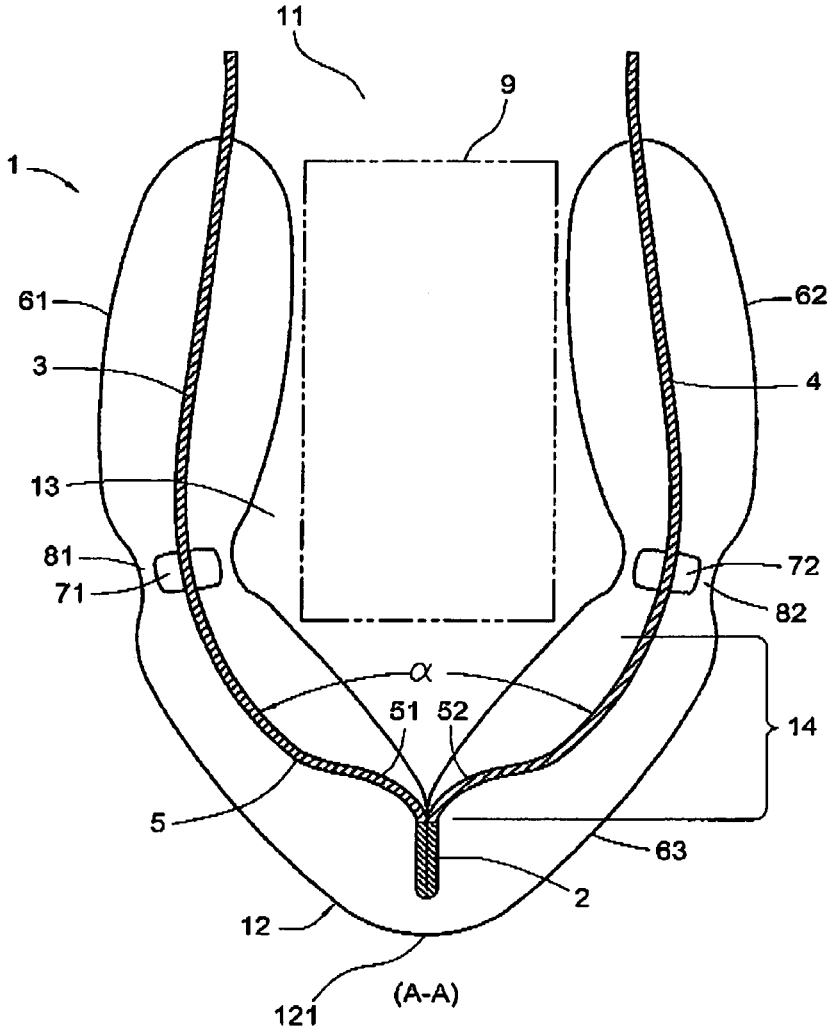
FIG. 3 is a sectional view taken along line A-A of FIG. 1.

Referring to FIG. 1 to FIG. 3, which show an embodiment of the present invention, a bag bottom cushioning structure for an inflated air cushion bag is provided at the bottom 12 of an inflated air cushion bag 1. The bag 1 has a first wall 3, a second wall 4, and a bottom wall 5 connecting the bottom of the first wall 3 and the bottom of the second wall 4. The first wall 3 and the second wall 4 are connected to each other along two lateral edges thereof. A receiving space 13 is formed between the first wall 3, the second wall 4, and the bottom wall 5. A bag opening 11 is formed between the top of the first wall 3 and the top of the second wall 4 and communicates with the receiving space 13.

The first wall 3 and the second wall 4 form two lateral sides of the bag 1 respectively. The bottom wall 5 forms the bottom 12 of the bag 1.

The bottom wall 5 is provided at intervals with a plurality of air columns 63. The air columns 63 extend toward the bag opening 11 along the first wall 3 and the second wall 4 respectively. Thus, as extensions of the air columns 63, a plurality of air columns 61 are formed on the first wall 3, and a plurality of air columns 62 are formed on the second wall 4.

Each of the first wall 3, the second wall 4, and the bottom wall 5 is formed with a plurality of hot-sealed lines by a hot-pressing process. The air columns 61 are divided from one another by the corresponding hot-sealed lines, and so are the air columns 62, 63.

First hot-sealed nodes 71 are provided between the air columns 61 on the first wall 3 and the air columns 63 on the bottom wall 5. Each first hot-sealed node 71 is flanked by one or a pair of first air paths 81, wherein each first air path 81 is in communication between one air column 61 on the first wall 3 and one air column 63 on the bottom wall 5. Likewise, second hot-sealed nodes 72 are provided between the air columns 62 on the second wall 4 and the air columns 63 on the bottom wall 5. Each second hot-sealed node 72 is flanked by one or a pair of second air paths 82, wherein each second air path 82 is in communication between one air column 62 on the second wall 4 and one air column 63 on the bottom wall 5.

The first hot-sealed nodes 71 and the second hot-sealed nodes 72 are so designed that the first wall 3, the second wall 4, and the bottom wall 5 as a whole have a curved configuration, or more specifically a generally U-shaped configuration as shown in FIG. 3.

In addition, referring to FIG. 3, the two inner lateral surfaces 51, 52 of the bottom wall 5 are bonded to each other by one or more fixedly connecting portions 2 in such a way that the air columns 63 on the bottom wall 5 at the bottom 12 of the bag 1 are bent, and hence protrude, away from the bag opening 11, forming an included angle $\alpha$. In this bent configuration, the air columns 63 on the bottom wall 5 form an extended curved-surface cushioning space 14 in communication with the receiving space 13, and a curved outer surface 121 is formed on each of the air columns 63 at the bottom wall 5 and is under and spaced apart from the one or more fixedly connecting portions 2 so as to enable the entire bottom 12 of the inflated air cushion bag 1 to be cushionable.

The fixedly connecting portions 2 may be provided at the air columns 63 on the bottom wall 5 or be provided between the air columns 63 on the bottom wall 5.

Figure 4:
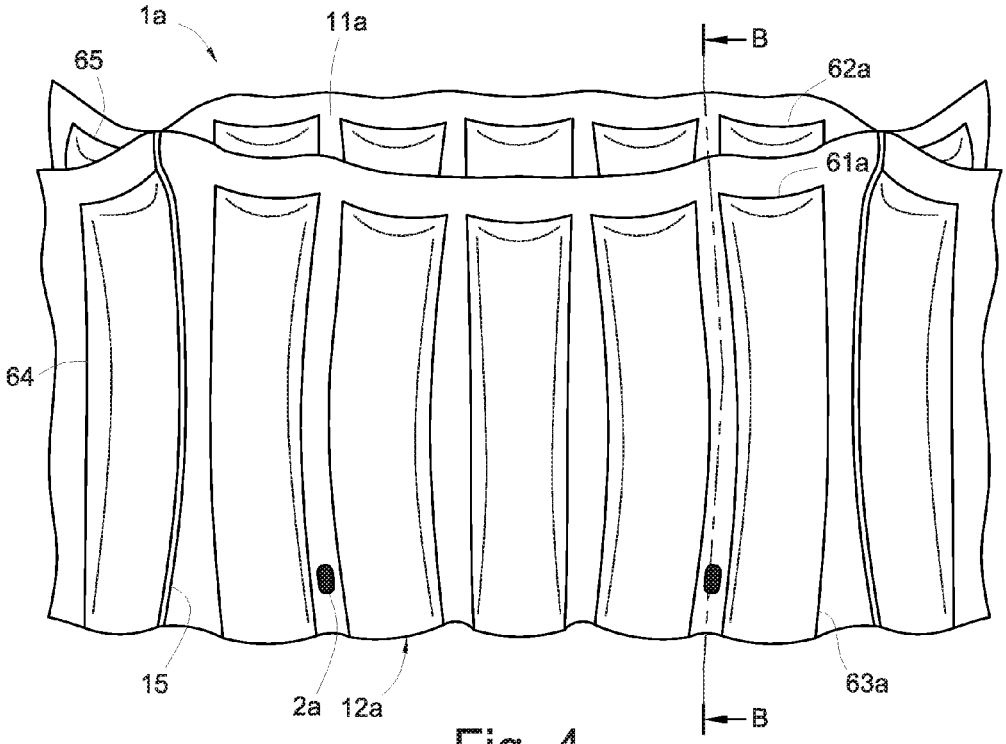
FIG. 4 is a front perspective view of the second embodiment of the present invention.

The present invention may further include the following technical features:

Preferably, the fixedly connecting portions 2 are provided on the bottom wall 5, are adjacent to two lateral ends of the bag 1 respectively, and each have a linear configuration or a dot-like configuration (as the fixedly connecting portions 2*a* shown in FIG. 4).

Preferably, the fixedly connecting portions 2, 2*a* are formed on the bottom wall 5 at the bottom 12 of the bag 1 by welding.

Preferably, each lateral edge of the bag 1 is provided with a sunken hot-pressed lateral connecting line 15 extending from the bag opening 11 to the bottom 12 of the bag 1. The lateral connecting lines 15 are respectively formed along the lateral edges of the bag 1 by welding, such that each lateral edge of the bag 1 is divided by the corresponding lateral connecting line 15 into an outwardly turned first lateral air column 64 located on one side of the bag 1 and an outwardly turned second lateral air column 65 located on the opposite side of the bag 1. Each pair of the corresponding first lateral air column 64 and second lateral air column 65 are connected to each other side by side to form a lateral cushioning surface 16 facing sideways of the bag 1.

Preferably, the first lateral air columns 64 are located at the lateral edges of the first wall 3 respectively, and the second lateral air columns 65 are located at the lateral edges of the second wall 4 respectively.

The present invention can be implemented using the components described above. With the fixedly connecting portions 2, 2*a* bonding the two inner lateral surfaces 51, 52 of the bottom wall 5 together, the air columns 63 on the bottom wall 5 are bent, and therefore protrude, away from the bag opening 11 together with the two inner lateral surfaces 51, 52 of the bottom wall 5, thus forming a bent configuration in which the air columns 63 on the bottom 12 of the bag 1 form the extended curved-surface cushioning space 14, which has a triangular shape tapering toward the bottom 12 of the bag 1.

It should be pointed out that the fixedly connecting portions 2, 2*a* are designed to bond the two inner lateral surfaces 51, 52 of the bottom wall 5 together without using additional material, and to thereby change the structural configuration of the air columns 63 on the bottom wall 5 and of the inner bottom surface of the receiving space 13.

Therefore, once an object 9 to be received is put into the receiving space 13 via the bag opening 11 of the bag 1, the outer surface of the object 9 is wrapped between the inner surface of the first wall 3 and the inner surface of the second wall 4. Now that the extended curved-surface cushioning space 14 tapers toward the bottom 12 of the bag 1, the bottom of the object 9 is kept from entering the extended curved-surface cushioning space 14 entirely. More particularly, the extended curved-surface cushioning space 14 will lie between the bottom of the object 9 and the inner bottom surface of the receiving space 13.

Should the bottom 12 of the bag 1 hit the ground, the impact force generated by the bottom 12 hitting the ground will be absorbed not only by the air columns 63 on the bottom wall 5, but also by the extended curved-surface cushioning space 14. Thus, the bottom of the object 9 is projected from damage by the impact force resulting from the bottom 12 of the bag 1 hitting the ground.

According to the above, the structural changes enabled by the fixedly connecting portions 2, 2*a* of the present invention take place in the absence of additional material and alter the direction in which the air columns 63 on the bottom 12 of the bag 1 extend, causing the two symmetric inner lateral surfaces 51, 52 of the bottom wall 5 to form an included angle. Consequently, the bottom 12 is bent and forms the extended curved-surface cushioning space 14 lying between the bottom of the object 9 and the bottom of the receiving space 13. In other words, the objective of bending the air columns 63 on the bottom 12 of the bag 1 and forming the extended curved-surface cushioning space 14 is achieved. With the extended curved-surface cushioning space 14 providing a buffer distance as great as the depth of the extended curved-surface cushioning space 14, the aforementioned drawbacks of the prior art are overcome, which drawbacks stem mainly from the tiny gap left between an object placed in a conventional inflated air cushion bag and the bottom of the bag, or a lack of such a gap, due to the weight of the object, for, in either case, an impact force generated by the bottom of the bag hitting the ground is very likely to reach the bottom of the object and thus damage the object.

Figure 5:
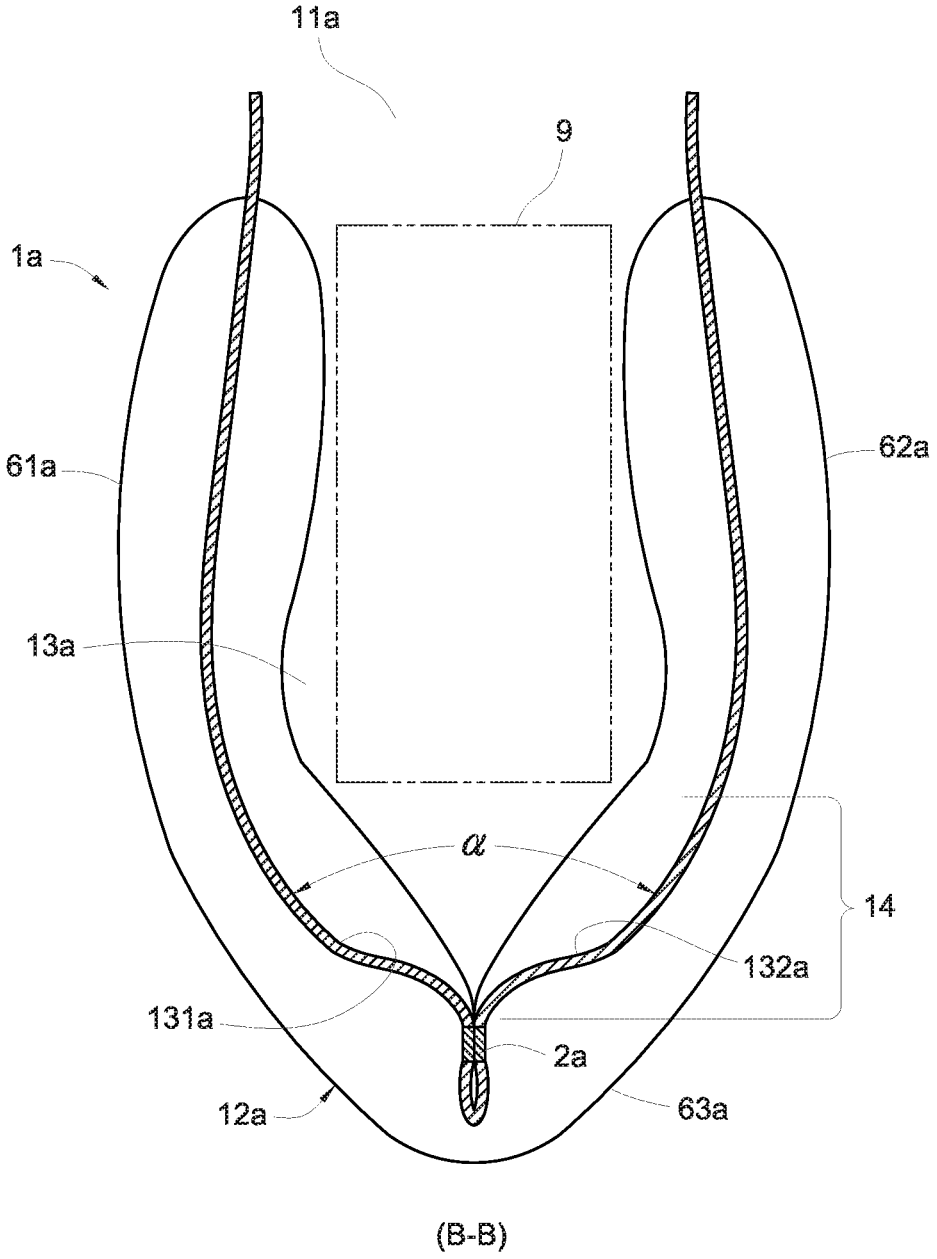
FIG. 5 is a sectional view taken along line B-B of FIG. 4.
Figure 6:
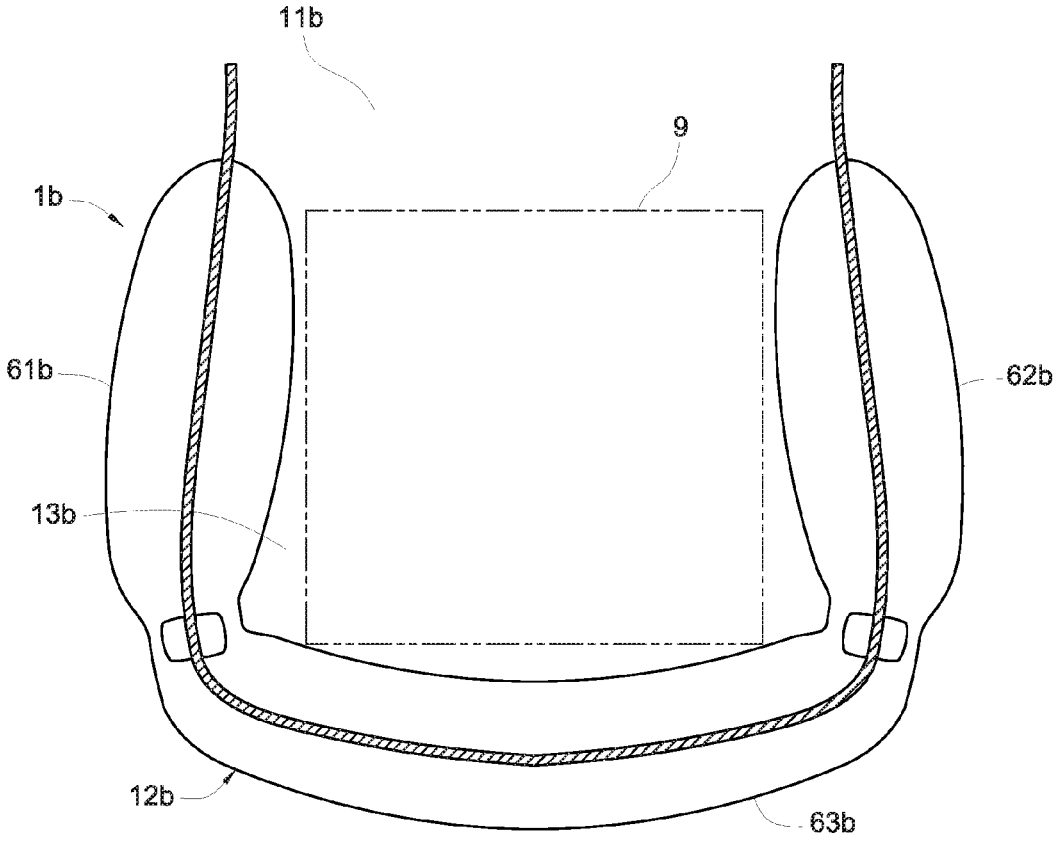
FIG. 6 is a sectional view of a conventional inflated air cushion bag.

FIG. 4 shows a front perspective view of the second embodiment of the present invention, and FIG. 5 is a sectional view taken along line B-B of FIG. 4. As shown in FIG. 4 and FIG. 5, a bag bottom cushioning structure according to the present invention is configured for use with an inflated air cushion bag 1*a* and, more particularly, is provided at the bottom 12*a* of the bag 1*a*. The bag 1*a* has a receiving space 13*a* therein. The top of the bag 1*a* has a bag opening 11*a* in communication with the receiving space 13*a*. The bottom 12*a* is provided at intervals with a plurality of air columns 63*a*. The air columns 63*a* extend toward the bag opening 11*a* along two lateral walls of the bag 1*a* respectively such that the two lateral walls of the bag 1*a* are respectively formed with a plurality of air columns 61*a* and a plurality of air columns 62*a* as extensions of the air columns 63*a*.

The two inner lateral surfaces 131*a*, 132*a* of the receiving space 13*a* are bonded together at the bottom 12*a* by one or more fixedly connecting portions 2*a*. As a result, the air columns 63*a* on the bottom 12*a* are bent, and therefore protrude, away from the bag opening 11*a*, form an included angle α, and, because of the bent configuration, form an extended curved-surface cushioning space 14.

The fixedly connecting portions 2*a* may be provided at or between the air columns 63*a* on the bottom 12*a*, and the aforesaid first and second hot-sealed nodes 71, 72 and first and second air paths 81, 82 may be dispensed with. Meanwhile, the rest of the components and the method of implementation are the same as those in the first embodiment.

According to the above, the objective of rendering the air columns 63*a* on the bottom 12*a* of the bag 1*a* into a bent configuration that forms the extended curved-surface cushioning space 14 is achieved, and the bottom of the object 9 is therefore protected from damage by an impact force generated by the bottom 12*a* of the bag 1*a* hitting the ground.

What is claimed is:

1. A bag bottom cushioning structure for an inflated air cushion bag, the bag bottom cushioning structure being provided at a bottom of the inflated air cushion bag, the inflated air cushion bag having a first wall, a second wall, and a bottom wall connecting a bottom of the first wall and a bottom of the second wall, the first wall and the second wall being connected to each other along two lateral edges thereof, there being a receiving space formed between the first wall, the second wall; and the bottom wall, a bag opening formed between a top of the first wall and a top of the second wall and in communication with the receiving space, the bottom wall being provided at intervals with a plurality of air columns, the air columns extending toward the bag opening along the first wall and the second wall respectively, the bag bottom cushioning structure being characterized in that:

the bottom wall has two inner lateral surfaces bonded together by one or more fixedly connecting portions in such a way that the air columns at the bottom wall are bent and thus protrude away from the bag opening, and thereby form an extended curved-surface cushioning space with an included angle formed by the air columns, and a curved outer surface formed on each of the air columns at the bottom wall under and spaced apart from the one or more fixedly connecting portions so as to enable the entire bottom of the inflated air cushion bag to be cushionable;

wherein the inflated air cushion bag has lateral edges each provided with a sunken hot-pressed lateral connecting line extending from the bag opening to the bottom of the inflated air cushion bag, each said lateral edge of the inflated air cushion bag being divided by a corresponding said lateral connecting line into an outwardly turned first lateral air column located on one side of the inflated air cushion bag and an outwardly turned second lateral air column located on an opposite side of the inflated air cushion bag, each pair of corresponding said first lateral air column and said second lateral air column being connected to each other side by side to form a lateral cushioning surface facing sideways of the inflated air cushion bag.

2. The bag bottom cushioning structure of claim 1, wherein first hot-sealed nodes are provided between the air columns on the first wall and the air columns on the bottom wall and are each flanked by one or a pair of first air paths, each said first air path being in communication between a said air column on the first wall and a said air column on the bottom wall; and wherein second hot-sealed nodes are provided between the air columns on the second wall and the air columns on the bottom wall and are each flanked by one or a pair of second air paths, each said second air path being in communication between a said air column on the second wall and a said air column on the bottom wall.

3. The bag bottom cushioning structure of claim 1, wherein the one or more fixedly connecting portions are provided at the air columns on the bottom wall or are provided between the air columns on the bottom wall.

4. The bag bottom cushioning structure of claim 1, wherein each said fixedly connecting portion has a dot-like or linear configuration.

5. The bag bottom cushioning structure of claim 1, wherein the one or more fixedly connecting portions are formed at the bottom of the inflated air cushion bag by welding.

6. A bag bottom cushioning structure for an inflated air cushion bag, the bag bottom cushioning structure being provided at a bottom of the inflated air cushion bag, the inflated air cushion bag having a receiving space therein and a top having a bag opening in communication with the receiving space, the bottom of the inflated air cushion bag being provided at intervals with a plurality of air columns, the air columns extending toward the bag opening along two lateral walls of the inflated air cushion bag respectively, the bag bottom cushioning structure being characterized in that:

the receiving space has two inner lateral surfaces bonded together at the bottom of the inflated air cushion bag by one or more fixedly connecting portions such that the air columns at the bottom of the inflated air cushion bag are bent and thus protrude away from the bag opening, and thereby form an extended curved-surface cushioning space, with an included angle formed by the air columns, and a curved outer surface formed on each of the air columns at the bottom wall under and spaced apart from the one or more fixedly connecting portions so as to enable the entire bottom of the inflated air cushion bag to be cushionable;

wherein the inflated air cushion bag has lateral edges each provided with a sunken hot-pressed lateral connecting line extending from the bag opening to the bottom of the inflated air cushion bag, each said lateral edge of the inflated air cushion bag being divided by a corresponding said lateral connecting line into an outwardly turned first lateral air column located on one side of the inflated air cushion bag and an outwardly turned second lateral air column located on an opposite side of the inflated air cushion bag, each pair of corresponding said lateral air column and said second lateral air column being connected to each other side by side to form a lateral cushioning surface facing sideways of the inflated air cushion bag.

7. The bag bottom cushioning structure of claim 6, wherein the one or more fixedly connecting portions are provided at the air columns on the bottom of the inflated air cushion bag or are provided between the air columns on the bottom of the inflated air cushion bag.

8. The bag bottom cushioning structure of claim 6, wherein each said fixedly connecting portion has a dot-like or linear configuration.

9. The bag bottom cushioning structure of claim 6, wherein the one or more fixedly connecting portions are formed at the bottom of the inflated air cushion bag by welding.

* * * * *